US006082920A

United States Patent [19]

Furukawa

[11] Patent Number: 6,082,920

[45] Date of Patent: Jul. 4, 2000

[54] BALL-POINT PEN

[75] Inventor: Kazuhiko Furukawa, Kanagawa, Japan

[73] Assignee: Mitsubishi Pencil Kabushiki Kaisha, Tokyo, Japan

[21] Appl. No.: 09/341,403

[22] PCT Filed: Nov. 21, 1997

[86] PCT No.: PCT/JP97/04264

§ 371 Date: Jul. 8, 1999

§ 102(e) Date: Jul. 8, 1999

[87] PCT Pub. No.: WO98/30401

PCT Pub. Date: Jul. 16, 1998

[30] Foreign Application Priority Data

Jan. 7, 1997 [JP] Japan ..... 9-011921
Jan. 7, 1997 [JP] Japan ..... 9-011922

[51] Int. Cl.[7] ..... B43K 23/08

[52] U.S. Cl. ..... 401/216; 401/209

[58] Field of Search ..... 401/216, 209, 401/212, 214, 215, 217

[56] References Cited

U.S. PATENT DOCUMENTS 5,520,473 5/1996 Durham ..... 401/216
5,876,142 3/1999 Furukawa ..... 401/216
5,904,432 5/1999 Ando et al. ..... 401/216

FOREIGN PATENT DOCUMENTS 45-1088 1/1970 Japan .
47-2817 2/1972 Japan .
2-261698 1/1990 Japan .
2-501557 5/1990 Japan .
6-15218 1/1994 Japan .
6-38709 1/1994 Japan .
7-251591 1/1995 Japan .
7-251592 1/1995 Japan .
8-252998 1/1996 Japan .
8-258479 10/1996 Japan .
9-76688 3/1997 Japan .

*Primary Examiner*—David J. Walczak
*Attorney, Agent, or Firm*—Darby & Darby

[57] ABSTRACT

A ball-point pen having a point assembly, in which the inside and outside diameters of a press formed portion (3) for preventing a ball (1) from slipping out, a sealing face (8), the projected amount of the ball, the diameter of a ball seat (16), the longitudinal backlash and the like are formed in optimized dimensions, sealing face (8) is configured so as to have a radius of curvature approximately equal to that of ball (1), and ball seat (16) having a radius of curvature approximately equal to that of ball (1) is formed in the rear of ball (1), while a multiple number of channels (4) for leading ink (13) to the pen point are provided inside the point assembly.

20 Claims, 4 Drawing Sheets

FIG. 1
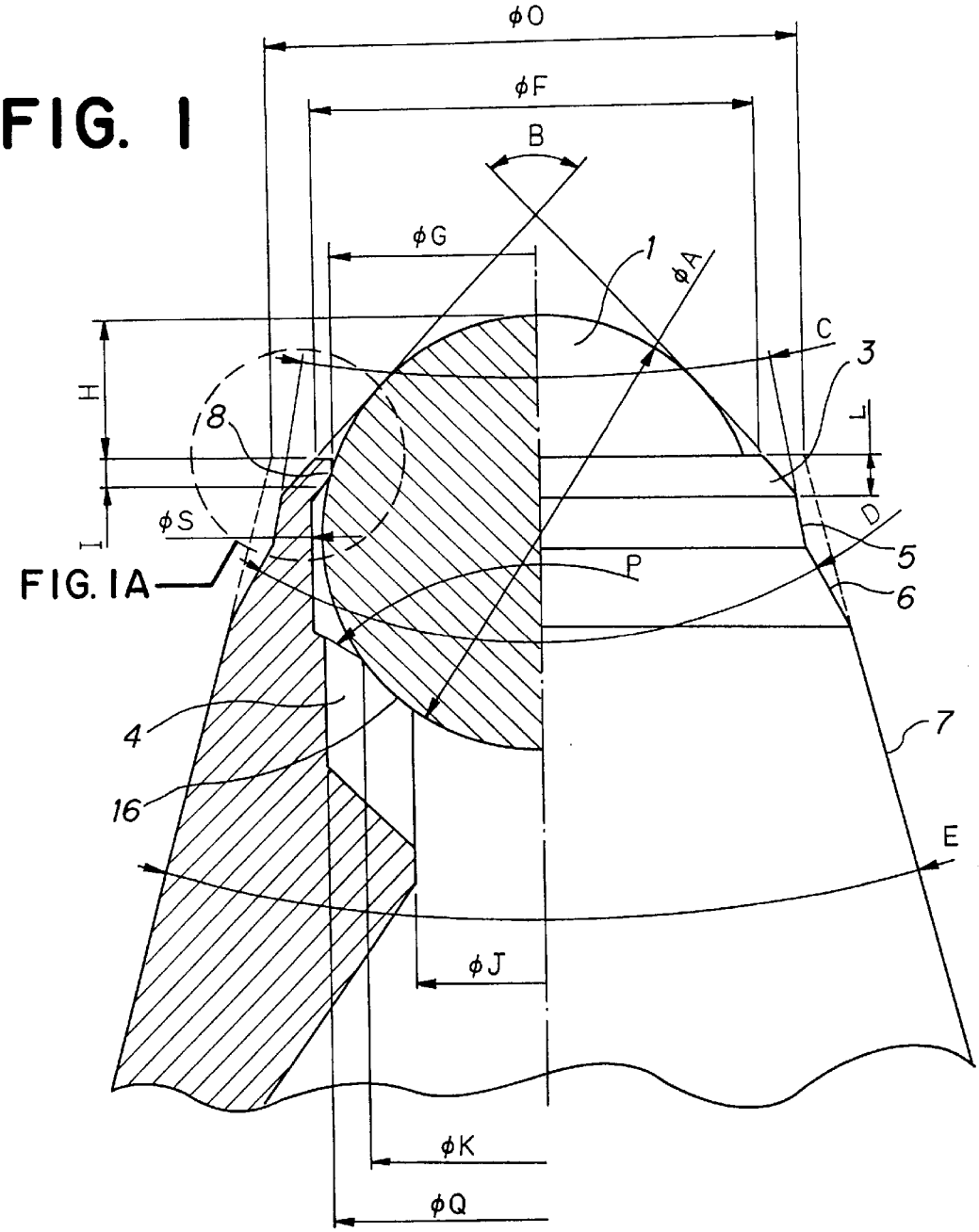
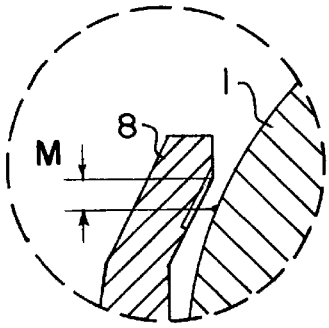
FIG. 1A

BALL-POINT PEN

TECHNICAL FIELD

The present invention relates to parts of a point assembly in which a ball disposed at its tip as a writing element is loosely held whilst being kept from slipping out with appropriately sized clearances which establish a flow passage of ink, and the invention further relates to improvement of a ball-point pen using the parts.

BACKGROUND ART

Conventionally, there have been ball-point pens and small-tube type writing implements where a cap with a sealing element therein composed of elastic rubber, etc., to seal the pen point is used when the pen is not used for long periods of time, in order to prevent evaporation of ink and in order to prevent ink starvation which would occur due to drawing of air through the pen point when the pen is impacted by being dropped as well as so-called forward leakage, that is, ink drip from the pen point. However, in the case of a clicking type ball-point pen as well as in the case where the user has forgotten to fit the cap, in the case of a writing implement where a volatile type of ink is necessary, and in other cases, ink starvation and air drawing tend to occur, and the writing implement itself sometimes tends to become disabled. Countermeasures against such cases, include: inhibiting ink evaporation as much as possible by creating the parts of a ball-point pen, using metal; increasing the viscosity of ink (up to about 5,000 cp to 10,000 cp); increasing the content of non-volatile solvent; decreasing the out-flow of ink by narrowing the ink flow passage in the point assembly; and creating an internal pressure in the barrel interior equal to or higher than the pressure of the surrounding air to cause the interior ink to flow out. In particular, these problems have not been resolved for so-called intermediate type ball-point pens which use ink of a medium viscosity and present intermediate properties between oily and aqueous ball-point pens. Although ball-point pens of this type have such imperfections, they have been put onto the market because of other merits. Some ball-point pens which are improved as to these problems have been invented, but no products are yet found which are free from the problem of abrasion in the interior of the point assembly.

In conventional ball-point pens, problems of forward leakage, air drawing and dry-up due to ink evaporation are mainly prevented mechanically, by substantially sealing ink or the interior of the barrel and pressurizing it (with a gas, or by pressing the barrel side face). Alternatively, if no such measures are used, a cap or an elastic material such as rubber etc., for ensuring airtightness are closely fitted on the pen point so as to protect the pen point. When manipulation with a barrel mechanism is used as a measure, the mechanism needs a complicated structure, which causes frequent mechanical accidents and is high in cost, thus increasing the price of the ball-point pen. Products in which the only means for prevention is the cap are not the essential solution because the cap is kept off during actual usage, and they also have the problem of deficiency in maintaining performance if the user does not frequently fit the cap. Further, when ink is manipulated as a countermeasure, a solution is obtained at the sacrifice of the writing performance, such as sluggish drying of drawn lines after writing, uncomfortable writing sensation, increased flow of ink as the pen point becomes abraded by the poor lubrication of the ink as it is used more, and slipping out of the ball or non-writing in the worst case.

The present invention is primarily to provide an improved writing implement of the so-called ball-point pen type wherein a ball projected from its tip as the writing point is loosely held with play inside the point assembly of a popular type and is kept from slipping out. The invention is to provide an inexpensive, high performance writing implement having a point assembly which is able to prevent the problems of dry-up, air drawing, forward leakage, etc., as well as the problem of blotting, i.e., staining of the paper due to adherence of ink to the pen point during writing, without needing a special ink or high-quality barrel mechanism and without compromising the manufacturing performance of the sealing portion in the point assembly having a sealing portion for sealing the interior from the outside air, by the combination of the writing ball and the interior sealing face having a curvature approximately equal to that of the writing ball.

DISCLOSURE OF INVENTION

The present invention has been devised to solve the above problems, and the gist of the invention is as follows:

The first feature of the present invention resides in ball-point pen comprising:

ink reservoir tube which stores an ink therein;

point assembly which is disposed in the front of the ink reservoir tube and holds a ball to be a writing point at the front end thereof by means of a press formed portion at the front end of the holder so that the ball is rotatably projected from the front part thereof and is prevented from slipping out; and aqueous ink, characterized by meeting all the following requirements 1) to 3):

1) the writing ball diameter $\phi A$, the diameter $\phi J$ of the ink hole constituting interior ink passage, the ball seat angle P and the ball seat diameter $\phi K$ satisfy the following relations:

$$100^\circ < P < 150^\circ$$

$$\phi A \times 0.40 < \phi J < \phi A \times 0.80$$

$$\phi A \times 0.50 < \phi K < \phi A \times 0.90$$

2) three or more channel grooves constituting an ink passage during writing, are provided in the rear, with respect to the axial direction, of the ball, the channel grooves being terminated partway not penetrating rearward to the ink reservoir tube, and the circumscribed circle diameter $\phi Q$ of the channels, the finished diameter $\phi S$, with respect to transversal direction, of the side wall for limiting the loosely held ball, the ball projected amount H when the ball is put in close contact with the ball seat and the ball seat diameter $\phi K$ satisfy the following relations:

$$\phi A \times 0.95 < \phi Q < \phi A \times 1.05$$

$$\phi A \times 1.02 < \phi S < \phi A \times 1.10$$

$$H \times 2.3 < \phi K$$

3) the loosely held ball can move in the axial direction with a longitudinal backlash M falling within the range:

$$\phi A \times 0.01 < M < \phi A \times 0.10.$$

Next, the second feature of the present invention resides in the ball-point pen defined in the above first feature, wherein the point assembly incorporates an elastic element such as a spring therein which constantly urges the ball forward in the axial direction with a weak force equal to or lower than 80 g.

The third and fourth features of the present invention reside in the ball-point pen defined in the above first or second feature, wherein the ink reservoir tube directly holds an aqueous ink having a viscosity ranging from 10 cp to 4000 cp at 23° C. and a greasy follower in contact with the ink at the rear end thereof, and all the parts which directly come in contact with the ink, such as the point assembly, ink reservoir tube etc., are formed of materials having a water absorptivity of 0.2% or below at room temperature.

Further, the fifth feature of the present invention resides in a ball-point pen comprising:

ink reservoir tube which stores an ink therein; and point assembly which is disposed in the front of the ink reservoir tube and holds a ball to be a writing point at the front end thereof by means of a press formed portion at the front end of the holder so that the ball is rotatably projected from the front part thereof and is prevented from slipping out, characterized by meeting all the following requirements 1) to 3):

1) the angle B of the tapered press formed portion, the writing ball diameter ϕA, the outside diameter ϕF of the press formed portion, the inside diameter ϕG of the press formed portion and the projected amount H of the ball satisfy the following relations:

$$60° < B < 100°$$

$$\phi A \times 0.90 < \phi F < \phi A \times 1.10$$

$$\phi A \times 0.90 < \phi G < \phi A \times 0.98$$

$$\phi A \times 0.20 < H < \phi A \times 0.40$$

2) the inside diametric portion has a circumferential sealing face having a width I and a radius of curvature approximately equal to the radius of the writing ball, I falling in the following range:

$$\phi A \times 0.01 < I < \phi A \times 0.15$$

3) the loosely held ball can move in the axial direction with a longitudinal backlash M falling within the range:

$$\phi A \times 0.01 < M < \phi A \times 0.10.$$

Moreover, the sixth feature of the present invention resides in the ball-point pen defined in the above fifth feature, wherein a circumferentially, discontinuous ball seat K having a radius of curvature approximately equal to the radius of the ball is provided in the rear, with respect to the axial direction, of the ball, the diameter ϕK falling in the following range:

$$\phi A \times 0.6 < \phi K < \phi A \times 0.9.$$

Next, the seventh and eighth features of the present invention reside in the ball-point pen defined in the above fifth or sixth feature, wherein the point assembly incorporates an elastic element such as a spring therein which constantly urges the ball forward in the axial direction with a weak force equal to or lower than 80 g; the spring or elastic element has an end turn portion or a substantially straight portion which is equivalent to the end turn portion, at the rear end thereof for stable placement; three or more channel grooves constituting ink passage during writing are formed in the rear, with respect to the axial direction, of the ball, the channel grooves being terminated partway not penetrating rearward to the ink reservoir tube.

Next, the ninth through twelfth features of the present invention reside in the ball-point pen having any one of the above fifth through eighth features, wherein tapered portions C, D and E are formed in the rear of press formed tapered portion B; the width I of the interior sealing face and the press formed width L on the outer side satisfy all the following requirements 4) to 6):

4) B>C, D>C, D>E, 5) 60°<B<100°, E<60°,

6) L×0.1<I<L.

Finally, the thirteen through twentieth features of the present invention reside in the ball-point pen having any one of the above fifth through twelfth features, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

As has been described, the ball-point pen of the present invention includes: a ball as a writing element which is rotatably placed at the tip so that it is projected outward but is prevented from slipping; and an ink reservoir tube containing ink therein. The interior of the point assembly is configured so that the ink can be fed directly to the rotatable ball as the writing portion through the ink passage which is constituted from a multiple number of channel grooves sized as appropriate with transversal backlash and longitudinal backlash which allows the ball to move in the up and down directions, and the like.

The ball is held loosely so as to freely rotate and is enclosed by means of press forming such as plastic deformation so as not to slip off.

In the present invention, the interior edge of the press formed portion is prevented from abrading by providing a stable ball seat portion and ink conduit portion by optimizing the projected amount of the ball, the ball seat diameter, the diameter of a channel circumscribing circle, the finished diameter and the like as well as by forming the ball seat, which is the rear-side abutment of the ball, with respect to the axial direction, so as to create longitudinal backlash and so as to have a radius of curvature approximately equal to that of the ball, thereby preventing the ball from rolling out from the seat during writing.

As a further effective configuration of the present invention, the point assembly may incorporate an elastic element such as a spring therein (to be referred to as spring, hereinbelow) which constantly urges the ball forward with a weak force equal to or lower than 80 g. Here, when the aforementioned channel grooves are terminated partway instead of being formed running through, the action of the spring can be ensured.

In particular, for so called 'intermediate type ball-point pens' which use an aqueous ink having a viscosity ranging from 10 cp to 4000 cp at 23±5° C., if the pen is configured without cap, the water content will evaporate from the ink producing the problem of deterioration of ink after a long period of storage. In the present invention, all the parts in contact with ink are made up of materials having a water absorptivity of 0.2% or below. The specific examples include polyolefines such as PP, PE, etc., polybutylene terephthalate, polyethylene terephthalate, vinyl resin, denatured polyphenylene ether, or other resins and alloy resins of these, metals and metal-plated or metal-coated resins. The effects of the present invention can be more enhanced by the combination of these with the above point assembly.

In the present invention, a reliable press formed portion can be formed by optimizing the projected amount of the ball and inside and outside diameters of the press formed portion so as to prevent the ball from slipping out. In this case, press forming is performed by relatively strong crimping until the inside diameter portion of the press formed portion abuts the ball so as to form a sealing face therein. This sealing face will form a circumference having a fixed width and a radius of curvature equal to that of the ball.

Further, the ball seat is formed so as to create longitudinal backlash and have a radius of curvature equal to that of the ball for abutment of the rear-side of the ball.

As a further effective configuration of the present invention, an open V-shaped tapered portion is formed in the rear of the press formed tapered portion and in front of the acute-angled tapered portion for user's improved view. The ball seat is formed so as to have a diameter falling within the range of $\phi A \times 0.6$ to $\phi A \times 0.9$ where $\phi A$ is the ball diameter, preferably within the range of 0.7A to 0.8A. The width I of the sealing face is formed smaller than the width L of the exterior press formed portion, specifically formed to be one-tenth of L or greater, preferably, 0.5L to 0.9L.

Further, an elastic element such as a spring (to be referred to as spring, hereinbelow) which constantly urges the ball forward with a weak force equal to or lower than 80 g (preferably not greater than 20 g) is provided. Here, when the aforementioned channel grooves are terminated partway instead of being formed running through, the action of the spring can be ensured.

In particular, for so called 'intermediate type ball-point pens' which use an aqueous ink having a viscosity ranging from 10 cp to 4000 cp at 23+5° C., the present invention becomes more effective.

Now, the actions of the above means for solution will be described. In the field of ball-point pens, in order to prevent ink evaporation, air drawing into the point assembly, or in order to prevent ink starvation, backward leakage and forward leakage due to impacts from being dropped, a sealing part, generally composed of rubber, for sealing the tip is provided for the cap; or a high viscosity ink or a ink which is not easily evaporated is used. However, this produces other new problems such as necessity of frequent capping, sluggish drying of drawn lines and the like. Further, for prevention of the ball seat from being abraded, a lubricant is added to the ink or included in an increased amount, or a surfactant is used to reduce abrasion. However, those countermeasures related to the ink would cause the ink to blot on the paper, or would cause the problem of forward leakage of ink from the pen tip due to reduction in surface tension of the ink. Alternatively, an increased amount of additives can deteriorate the ink stability over time.

The improvement of the present invention makes it possible to solve the problems related to abrasion by appropriately sizing the ball seat with a radius of curvature equal to that of the writing ball, whilst securing sufficient dimensions of other parts relating to abrasion. Thereby, it is possible to prevent the ball from coming out or prevent writing disability.

In general, the writing implement is used to write whilst being inclined at an angle of about 60° with the paper plane. Therefore, the larger the ball seat, the less the ball tends to roll out from the ball seat during writing and hence the less abraded is the inner front edge of the press formed portion. However, when the ball seat is too large, the flow passage between the channels and the ball for securing ink flow is narrowed, causing unstable ink flow and/or choking the channels during writing to cause writing disability. The present invention is also effective in solving these problems simultaneously.

Further, the provision of a spring which constantly urges the ball forwards, produces reliable sealing performance as well as secures reliable sealing when the ball-point pen is oriented upward. In particular, the present invention functions most effectively when it is applied to an intermediate type ball-point pen using an ink having a relatively low viscosity. For the ball-point pens of an aqueous ink type which are usable with a cap-less configuration, the total performance of the point assembly, having the sealability, and the spring in combination can be found out by the ink reduction from the writing element due to evaporation. Accordingly, the parts to be used therein are preferably made up of materials having as low a moisture absorptivity (=water desorptivity) as possible. From these specifications, it is possible to provide a ball-point pen having stable quality.

In accordance with the improvement of the present invention, press forming is performed so that a sealing portion will be formed so as to have an interior shape equi-formed to the writing ball. Thereby, the seal for shutting out the external air can be made perfect. Further, since the angle of press forming and the inside and outside diameters after press forming are optimized, it is possible to produce a perfect sealing surface free from fluctuation. Further the ink flow can be stabilized by setting the sealing width smaller than the width L of the exterior press formed portion and equal to or greater than one-tenth thereof while securing sufficient dimensions of parts relating to abrasion. Thereby, it is possible to prevent the ball from coming out or prevent writing disability.

In general, the writing implement is used to write whilst being inclined at an angle of about 60° with the paper plane.

Therefore, the open V-shaped tapered portion located in the rear of the press formed portion, provides the function of preventing scratchiness against the paper surface as well as providing the function of forming a wall of regulated thickness during press forming and hence stabilizing the ink flow amount.

Further, the provision of a spring, which has an end turn portion at its rear end as appropriate and hence provides continuous stable urging of the ball, produces a reliable sealing performance as well as secures reliable sealing when the ball-point pen is oriented upward. In particular, the present invention functions most effectively when it is applied to an intermediate type ball-point pen using an ink having a relatively low viscosity. The exterior tapered configuration of the present invention functions to prevent the so-called blotting problem in that ink climbs up the pen tip during writing and the collecting ink drops after a certain period of time staining the paper, by inhibiting the climbing of ink. Further, by limiting the size of the ball seat, it is possible to prevent the occurrence of abnormal abrasion in the press formed portion and/or ball seat due to rolling of the ball during writing. Finally, a ball-point pen having stable quality can be given by regulating the reduction due to evaporation from the writing element, which indicates the total performance of the ink and the point assembly having a sealing face, in combination.

BRIEF DESCRIPTION OF THE DRAWINGS

FIG. 1 is a vertical sectional and external half view showing the structure of a point assembly at the front end of a ball-point pen in accordance with the first embodiment of the present invention;

THE BEST MODES FOR CARRYING OUT THE INVENTION

Figure 2:
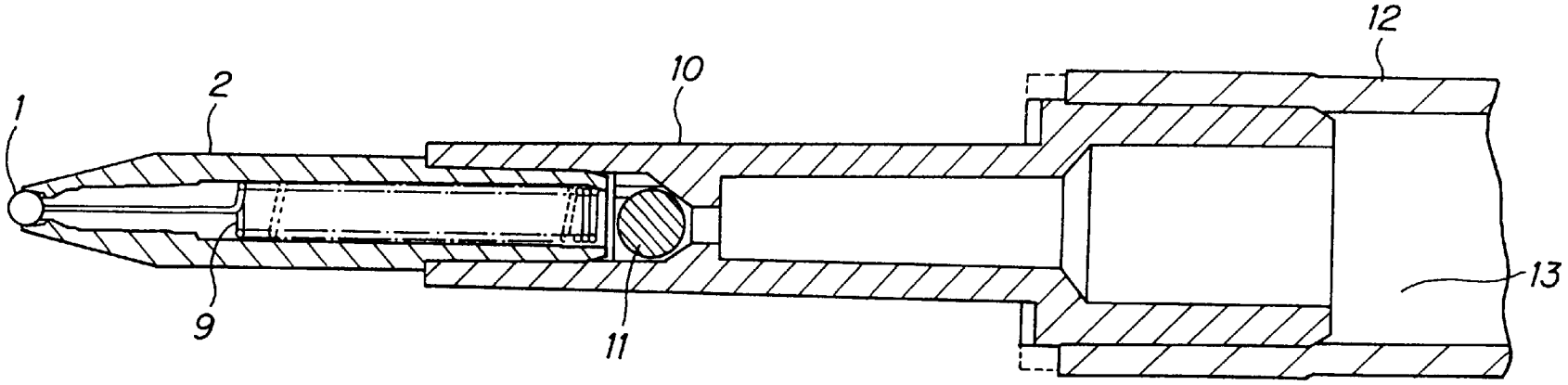
FIG. 2 is a vertical sectional view showing the structure of a front-most part of a ball-point pen in accordance with the first embodiment of the present invention.
Figure 3:
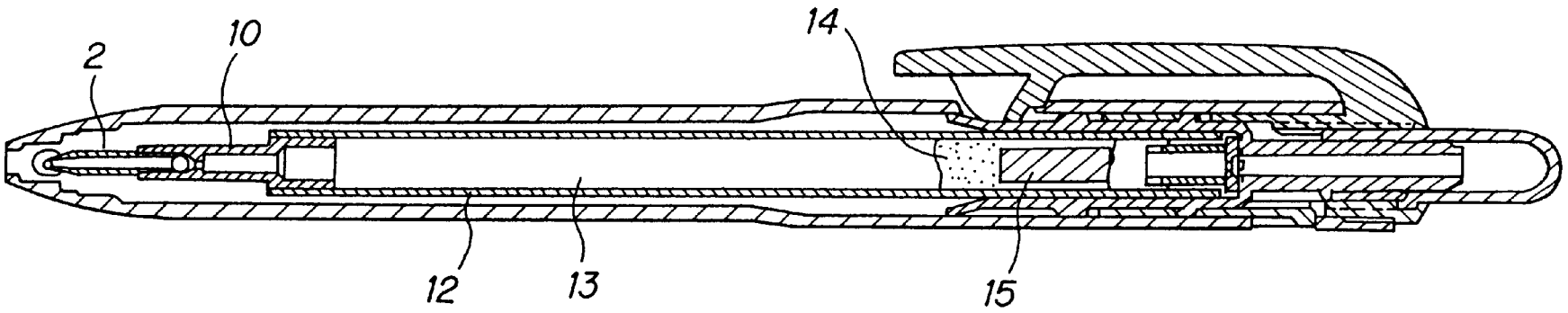
FIG. 3 is a vertical sectional view showing the overall configuration of a ball-point pen in accordance with the first embodiment of the present invention.

FIGS. 1 to 3 illustrate an example of a ball-point pen of the first embodiment of the present invention, and description will be made referring to the figures.

An ink reservoir tube stores an ink, a greasy follower at the rear of, and in contact with, the ink and a solid follower rod 15 having a specific gravity approximately equal to that of the follower, with the ink and follower having been degassed during manufacturing. The follower 14 is effective in preventing backward leakage and inhibiting evaporation. The follower rod 15 is floating in the follower and hence produces capillary force so as to enable the follower to readily follow the ink 13 as the ink is consumed during writing. The following rod also prevents the follower from being broken and leaking when the pen is impacted by being dropped. A writing ball 1 is fitted at the tip of the point assembly 2 so as not to fall off by the combination of the front side press formed portion and the ball seat 16 on the rear side. The ball 1 is loosely held so as to be rotatable with a longitudinal backlash M, formed in the front-to-rear direction, of $\phi A \times 0.01$ to $\phi A \times 0.10$ ($\phi A$=ball diameter), or more preferably with a backlash of $0.03\phi A$ to $0.08\phi A$.

The press formed portion 3 is formed with a press forming angle of 60° to 100° (preferably 70° to 90°) by, usually, plastic deformation of metal, or the combination of plastic deformation and machining. The interior face of the press formed portion 3 is formed with a sealing surface B having a radius of curvature which is approximately equal to that of the ball so that the ball 1 abuts the sealing surface B to thereby substantially shut out the interior of the ball-point pen from the outside air, forming a so-called sealed state.

If the inside diameter of the press formed portion is large, the ball 1 might come out causing writing deficiency due to slight wear at the front inner part during writing. As to the ball seat 16, if it is large, the ball 1 is placed stably thereon, whereas if the seat is small, the ball tends to roll off due to friction between the ball's rotation and the ball seat during writing and may abrade the front inner diametric rim of the press formed portion. Further, if the ink conduit diameter is too small, the flow amount is too low due to the narrow ink flow passage. If the area of the ball seat (determined by the ink conduit diameter and the ball seat 16 diameter) is too large, the contact area with the ball 1 becomes so large to disturb the ball's smooth rotation. On the other hand, if the area of abutment is too small, the portion for receiving the writing pressure is small, so that the ball seat may become abraded very quickly causing inability of writing due to sinking in of the ball even when ink yet remains. In conclusion, it was found that simple control of individual dimensions cannot meet multiple conditions, and these dimensions will affect each other, to produce the final performance. Specifically, the optimal relationship was found to be that where the ink conduit diameter $\phi J$ is 0.4 to 0.8 times of the ball diameter $\phi A$ (preferably $0.45\phi A$ to $0.65\phi A$) and the ball seat diameter $\phi K$ is 0.5 to 0.9 times of $\phi A$ (preferably $0.6\phi A$ to $0.8\phi A$).

In general, it may be considered that when a greater sealing surface 8 is formed by enhanced press forming, the product will be improved. However, an excessively large sealing surface 8 narrows the interior space and produces a greater friction with the ball to thereby reduce the amount of ink flow and degrade the writing performance. It has been found that in order to define the extent of press forming and the writing performance, it is important to limit the dimensions such as projected amount H of the ball, inner press-forming diameter $\phi G$, outside diameter $\phi F$, sealing face width I, press forming angle B, longitudinal backlash M, etc., in a related manner so as to satisfy the relations defined as follows. It was also found that a synergistic effect which cannot be produced by each acting independently can be obtained. The specifications in parentheses indicate the ranges which are more preferable.

$$60° < B < 100° \ (70° \text{ to } 90°)$$

$$\phi A \times 0.90 < \phi F < \phi A \times 1.10$$

(1.01$\phi$A to 1.08$\phi$A)

$$\phi A \times 0.90 < \phi G < \phi A \times 0.98$$

(0.92$\phi$A to 0.97$\phi$A)

$$\phi A \times 0.20 < H < \phi A \times 0.40$$

(0.27$\phi$A to 0.35$\phi$A)

$$\phi A \times 0.01 < I < \phi A \times 0.15$$

(0.03$\phi$A to 0.10$\phi$A)

$$\phi A \times 0.01 < M < \phi A \times 0.10$$

(0.03$\phi$A to 0.08$\phi$A)

Illustratively, in view of adjusting the scratchy feeling of the ball to the paper surface during writing, it is believed to be preferable (less scratchy) that the projected amount of the ball be set as large as possible. Therefore, this amount has been, in most cases, set at a value above which the ball can no longer be held. The inside and outside diameters of the press formed portion were determined consequently by the projected amount of the ball (i.e., when the projected amount of the ball is smaller, the inside and outside diameters will be smaller). Even in the case where the projected amount of ball is relatively large, if the outside diameter is large, the scratchiness against the paper surface becomes large. On the other hand, some having a large inside diameter are liable to be abraded, at the internal front part, by writing, so that the ball would slip out resulting in a writing deficiency. Besides, the projected amount of the ball, the inside and outside diameters and the angle of press forming greatly affect the dimension of the inside sealing face. Briefly, it was found that adjustment of each of these dimensions alone cannot meet the required multiple performances and the different factors affect each other to produce the final performance.

The ball seat provided at the rear of the ball is adapted to have the same radius of curvature so as to produce a beneficial ball abutment during writing. The ball seat diameter $\phi K$ is set 0.6 to 0.9 times of the ball diameter $\phi A$ in order to eliminate the problem of the ball slipping out from the ball seat due to the rotation during writing and abrading the front interior part and in order to secure the required longitudinal backlash. Ink 13 can move from the ink reservoir tube 12 to the interior of the point assembly-and the ink flow passage to the ball is secured by channels 4, longitudinal and transversal backlashes of the ball 1. It is more effective if a spring 9 which continuously and slightly urges the ball 1 forward is provided inside the point assembly 2 by forming crimped points at the rear end of the point assembly 2. This spring 9 may have a straight portion in the front part thereof to directly urge the ball 1, or may have other configurations such that a spring 9 is used with a separate piece (not shown) whose rear end is urged by the spring 9, or the rear end of the spring may be fixed so as not to come out, by a stepped portion in the bore of the joint 10 instead of crimped points. Further, the spring 9 may be formed of resin, rubber or be a leaf spring etc. Any of these may be effective and show no difference. Here, an end turn portion or a substantially straight portion which is equi-formed to the interior of the fixture side is provided at the rear end of the spring so as to prevent the spring from popping out, in corporation with crimped points and thereby press the ball stably and straightforwardly.

Setting relation of the seat angle P is analogous to that of the above-described seat diameter. That is, when the angle is acute, the ball tends to be directed toward the center during writing, whereas this tendency is less with a large seat angle. On the other hand, as to the flow amount of ink and durability against abrasion, the gap between the ball 1 and channels 4 is easily blocked even with a slight abrasion when the seat angle is acute, whereas this blockage does not occur with a large seat angle. Specifically, the seat angle P is optimally set at 100° to 150°. It was also found that the longitudinal backlash M should be effectively sized between 0.01 to 0.10 times of the ball diameter (more preferably 0.03A to 0.08A) since the longitudinal backlash M also has a significant effect on the flow amount of ink.

In general, the point assembly has an acute-angled tapered portion E(7) at the rear of the front press formed portion in order to improve the user's view of the pen point during writing. Further, tapered portions C(5) and D(6) which form a substantially open V-shape are provided to achieve a further improved view. When a sealing face is formed, ink becomes more difficult to flow than in a configuration which is press formed in a normal manner, since the ink passage becomes narrower and longer. However, since this open V-shaped tapered configuration makes it possible to reduce excessive wall thickness of the press formed portion, this prevents deformation of the interior, specifically, the ink passage from becoming unnecessarily too long. Further, surplus ink collects around the outer peripheral portion at the pen point and drops after a certain period of time. However, this open V-shaped tapered portion is too steep to allow the ink to climb up, thus making it possible to prevent ink blotting.

The ink 13 used in the first embodiment has a viscosity of 10 cp to 4,000 cp at the temperature of 23° C.±5° C. under normal shearing force, and comprises: water as the base, other solvents such as glycerin, propylene glycol etc., in an amount of 5 to 50%, pigments and/or dyes as coloring agent in an amount of 1 to 20%, and other various additives, such as dispersant, gelatinizer, preservative, surfactant, moisturizer etc. as appropriate. Now, considering the reduction due to evaporation as it relates to total performance of ball-point pens, the use of the point assembly of the present invention improves the sealing performance at the tip portion of the pen, so as to suppress the evaporation of water from the pen. This feature enables an ink which is usually known to dry easily to be used in a cap-less ball-point pen. Even when the sealing face inside the point assembly is rather small and hence only a low amount of evaporation leakage occurs, no practical problem will occur if the evaporation of the ink itself is low. When an excessive amount of ink evaporates, the ink will reduce in amount during transportation and during storage before the user gets the product so that the product cannot ensure the nominal writing distance (life) or cannot maintain its performance due to ink degeneration. When little amount of ink evaporates (when the ratio of the non-volatile solvent is increased), solidification of the ink at the pen point cannot be expected and the ink adhering at the pen point absorbs moisture causing the problem of forward leakage, or the problem that the drawn lines on the paper will not dry quickly. In conclusion, in order to maintain the total performance of a ball-point pen of the present invention, it is important to control the reduction in weight due to evaporation when the pen has been left without cap at a temperature of 23° C.±5° C. under a humidity of 60%±15% so as to fall within the range of 0.06 mg/day to 0.8 mg/day (preferably 0.1 to 0.5 mg/day) on the average over 30 days. In some cases even when the above conditions are met, a point assembly of the present invention may not overcome the above problems if the parts of the ball-point pen, which come in direct contact with the ink are moisture-absorbing or moisture-desorbing. That is, in order to avoid loss of moisture from the ink reservoir tube 12, joint 10, etc., it is of course important to assemble these parts tightly so as to prevent leakage, but also it is important to use materials having a moisture absorptivity of 0.2% or below as the assembly parts. Here, the ink reservoir tube 12, joint 10 and follower rod are made up of polypropylene resin having a moisture absorptivity of 0.01%, while the point assembly is made up of stainless steel having a moisture absorptivity of 0% and the follower at the rear end uses a mineral oil based material having a moisture absorptivity of 0.01% or below.

Figure 4:
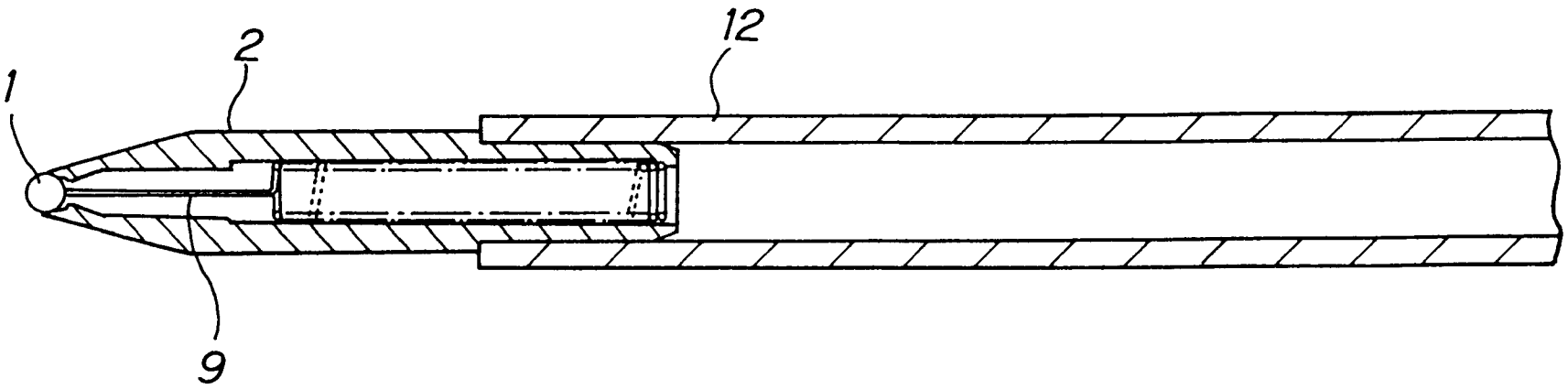
FIG. 4 is a vertical sectional view showing the structure of a front part of a ball-point pen in accordance with the second embodiment of the present invention.

FIG. 4 illustrates the second embodiment of the present invention, and its difference from the first embodiment is that the point assembly 2 is directly fixed by press fitting to the ink reservoir tube 12 instead of using a joint. The effects of this invention are the same as those of the first embodiment.

Table 1 shows the summarized results as to the conventional examples, examples and comparative examples in which the dimensions are different. For the evaluation of the examples, the measurement conditions, used parts and set values are as follows:

[Ink and barrel body]: UM-100 black, a product of MITSUBISHI PENCIL KABUSHIKI KAISHA, evaluated without cap; aqueous ink viscosity: 100 cp; and the barrel used and other parts are those on the market.

[Description of labels]

A: writing ball diameter; B: press forming angle; C and D: Open V-shaped tapered angle; E: acute tapered angle; F: outer press forming diameter; G: inner press formed diameter; H: ball projected amount; I: sealing face width; K: ball seat diameter; L: press formed width; and M: longitudinal ball backlash (refer to FIG. 1, unit: mm)

CONVENTIONAL EXAMPLE 1

A=ϕ0.5; E=30°; B=70°; F=0.98A; I=0 (none); H=0.4A; G=0.95A; M=0.03A; K=0.7A; C and D: none.

CONVENTIONAL EXAMPLE 2

A spring (15g) was incorporated in conventional example 1.

CONVENTIONAL EXAMPLE 3 an ink having double the non-volatile solvent was used, other settings were the same as conventional example 1.

EXAMPLE 1

I=0.2; L=0.02A; C=20°; D=60°; H=0.35A; F=1.08A; G=0.97A, other settings were the same as conventional example 2.

EXAMPLE 2

I=0.9; L=0.14A; H=0.3A; F=0.92A; G=0.91A, other settings were the same as example 1.

EXAMPLE 3

K=0.85A, other settings were the same as example 1.

COMPARATIVE EXAMPLE 1

B=60°, I=0.4A, other settings were the same as example 1.

COMPARATIVE EXAMPLE 2

F=1.15A; G=0.99A, other settings were the same as example 1.

COMPARATIVE EXAMPLE 3

H=0.15A; K=none, other settings were the same as example 1.

The evaluation as to writing feeling, forward leakage, abrasion, ink flow, ink starvation, was made with three levels: ○ for good, Δ for usable, and × for unusable.

Writing feeling: evaluated by observing the friction with paper during hand writing;

Forward leakage: evaluated by observing ink leakage with the pen tip down;

Durability against abrasion: evaluated based on the JIS machine writing test to the end of ink;

Ink flow: evaluated based on the flow amount of ink and the density of drawn lines in the JIS machine writing test; State of ink starvation without cap; ink starvation during hand writing evaluated after the pen was left without cap 30 days and in a 23° C. 60% RH environment.

Ink reduction due to evaporation: reduction after 30 days in a 23° C. 60% RH environment, measured by daily average.

The judgement was determined based on whether the invention can be used as a cap-less ball-point pen. The unit for ink reduction was mg/day. For the inks having an evaporation amount of 0.8 or more, deterioration of the physical properties over time were observed from the storage test, so that the tests for those were omitted.

TABLE 1

| | Write feeling | Forward leakage | Abrasion | Flow Amount | Starvation | Reduction | Judgement |
|---|---|---|---|---|---|---|---|
| Conv. Ex. 1 | ○ | X | X | ○ | X | 0.6 | NG |
| | Much forward leakage and ball slipped out, starvation was found without cap. | | | | | | |
| Conv. Ex. 2 | ○ | Δ | X | ○ | Δ | 0.5 | NG |
| | Abraded ball slipped out | | | | | | |
| Conv. Ex. 3 | ○ | X | X | ○ | ○ | 0.05 | NG |
| | Heavy forward leakage, abrasion, drawn lines were undryed. | | | | | | |
| Example. 1 | ○ | Δ | Δ | ○ | ○~Δ | 0.3 | OK |
| | Little forward leakage, some abrasion without usage problem | | | | | | |
| Example. 2 | ○ | ○ | Δ | Δ | ○ | 0.2 | OK |
| | Some abrasion, somewhat lower flow amount without usage problem | | | | | | |
| Example. 3 | ○ | ○ | ○ | ○ | ○~Δ | 0.3 | OK |
| | No problem | | | | | | |
| Comp. Ex. 1 | ○ | Δ | Δ | X | ○ | 0.2 | NG |
| | Low ink flow amount with thin drawn lines | | | | | | |
| Comp. Ex. 2 | X | Δ | X | Δ | Δ | 0.5 | NG |
| | Large friction with paper, ball slipped out. | | | | | | |
| Comp. Ex. 3 | X | Δ | X | ○ | ○~Δ | 0.3 | NG |
| | Large friction with paper, the ball seat was heavily abraded. | | | | | | |

The application of the present invention makes it is possible to solve the problems of an intermediate type ball-point pen of a clicking type using aqueous ink, which were unfeasible to solve in the prior art, as well as the problems of a ball-point pen having a cap with no sealing member therein, and the problems of an oily ball-point pen and of a direct liquid type ball-point pen. Naturally, combination of the present invention with a conventional cap type or clicking type barrel mechanism makes it possible to provide a further beneficial, distinctive ball-point pen.

Industrial Applicability

In accordance with the present invention, since it is possible to create reliable sealing at the pen tip, the pen does not need a cap or only needs a simple type of cap, without the necessity of high sealing ability therein. Therefore, it becomes possible to stably provide low-cost writing implements which are ready to be assembled as well as writing implements of a clicking type which were unfeasible in the prior art. Further, since reliable sealing can be created, it is possible to solve the problems concerning forward leakage, air drawing, ink starvation and ball slipping out in connection with durability against abrasion even in a ball-point pen using an aqueous ink which easily gets dry, without using any special ink or any complicated mechanisms. In particular, it is possible to expect more improved effects, in a configuration in which a spring is incorporated inside the point assembly so as to continuously press the writing ball forward in close contact with the interior sealing face of the present invention as well as in a configuration in which the dimensions of the parts and/or reduction amount due to evaporation are set within the ranges of the present invention. The present invention is effective in solving most of the defects in a so-called intermediate type ball-point pen using a medium viscosity ink, which had many drawbacks. It is also possible to expect further improved effects when the point assembly of the invention is combined with a configuration using an ink having thixotropy, which presents a varying viscosity dependent on shear force so that the ink presents a rather high viscosity during storage and a lowered viscosity during writing due to the shear force from the ball. Moreover, the present invention can show the same effects if it is applied to conventional oily type ball-point pens or, sliver type ball-point pens, direct liquid type aqueous ball-point pens using an ink storage part of many comb-like slits and other types. The present invention is more effective in providing a problem-free writing implement when it is combined with an anti-backward leakage mechanism such as a checking valve ball 11, etc.

What is claimed is:

1. A ball-point pen comprising:

ink reservoir tube which stores an ink therein;

point assembly which is disposed in the front of the ink reservoir tube and holds a ball to be a writing point at the front end thereof by means of a press formed portion at the front end of the holder so that the ball is rotatably projected from the front part thereof and is prevented from slipping out; and aqueous ink, characterized by meeting all the following requirements 1) to 3):

1) the writing ball diameter ϕA, the diameter ϕJ of the ink hole constituting interior ink passage, the ball seat angle P and the ball seat diameter ϕK satisfy the following relations:

$$100° < P < 150°$$

$$\phi A \times 0.40 < \phi J < \phi A \times 0.80$$

$$\phi A \times 0.50 < \phi K < \phi A \times 0.90$$

2) three or more channel grooves constituting an ink passage during writing, are provided in the rear, with respect to the axial direction, of the ball, the channel grooves being terminated partway not penetrating rearward to the ink reservoir tube, and the circumscribed circle diameter ϕQ of the channels, the finished diameter ϕS, with respect to transversal direction, of the side wall for limiting the loosely held ball, the ball projected amount H when the ball is put in close contact with the ball seat and the ball seat diameter ϕK satisfy the following relations:

$$\phi A \times 0.95 < \phi Q < \phi A \times 1.05$$

$$\phi A \times 1.02 < \phi S < \phi A \times 1.10$$

$$H \times 2.3 < \phi K$$

3) the loosely held ball can move in the axial direction with a longitudinal backlash M falling within the range:

$$\phi A \times 0.01 < M < \phi A \times 0.10.$$

2. The ball-point pen according to claim 1, wherein the point assembly incorporates an elastic element such as a spring therein which constantly urges the ball forward in the axial direction with a weak force equal to or lower than 80 g.

3. The ball-point pen according to claim 2, wherein the ink reservoir tube directly holds an aqueous ink having a viscosity ranging from 10 cp to 4000 cp at 23° C., and a greasy follower in contact with the ink at the rear end thereof, and all the parts which directly come in contact with the ink, such as the point assembly, ink reservoir tube etc., are formed of materials having a water absorptivity of 0.2% or below at room temperature.

4. The ball-point pen according to claim 1, wherein the ink reservoir tube directly holds an aqueous ink having a viscosity ranging from 10 cp to 4000 cp at 23° C. and a greasy follower in contact with the ink at the rear end thereof, and all the parts which directly come in contact with the ink, such as the point assembly, ink reservoir tube etc., are formed of materials having a water absorptivity of 0.2% or below at room temperature.

5. A ball-point pen comprising:

ink reservoir tube which stores an ink therein; and point assembly which is disposed in the front of the ink reservoir tube and holds a ball to be a writing point at the front end thereof by means of a press formed portion at the front end of the holder so that the ball is rotatably projected from the front part thereof and is prevented from slipping out, characterized by meeting all the following requirements 1) to 3):

1) the angle B of the tapered press formed portion, the writing ball diameter ϕA, the outside diameter F of the press formed portion, the inside diameter ϕG of the press formed portion and the projected amount H of the ball satisfy the following relations:

$$60° < B < 100°$$

$$\phi A \times 0.90 < \phi F < \phi A \times 1.10$$

$$\phi A \times 0.90 < \phi G < \phi A \times 0.98$$

$$\phi A \times 0.20 < H < \phi A \times 0.40$$

2) the inside diametric portion has a circumferential sealing face having a width I and a radius of curvature approximately equal to the radius of the writing ball, I falling in the following range:

$$\phi A \times 0.01 < I < \phi A \times 0.15$$

3) the loosely held ball can move in the axial direction with a longitudinal backlash M falling within the range:

$$\phi A \times 0.01 < M < \phi A \times 0.10.$$

6. The ball-point pen according to claim 5, wherein a circumferentially, discontinuous ball seat K having a radius of curvature approximately equal to the radius of the ball is provided in the rear, with respect to the axial direction, of the ball, the diameter ϕK falling in the following range:

$$\phi A \times 0.6 < \phi K < \phi A \times 0.9.$$

7. The ball-point pen according to claim 6, wherein the point assembly incorporates an elastic element such as a spring therein which constantly urges the ball forward in the axial direction with a weak force equal to or lower than 80 g; the spring or elastic element has an end turn portion or a substantially straight portion which is equivalent to the end turn portion, at the rear end thereof for stable placement; three or more channel grooves constituting ink passage during writing are formed in the rear, with respect to the axial direction, of the ball, the channel grooves being terminated partway not penetrating rearward to the ink reservoir tube.

8. The ball-point pen according to claim 7, wherein tapered portions C, D and E are formed in the rear of press formed tapered portion B; the width I of the interior sealing face and the press formed width L on the outer side satisfy all the following requirements 4) to 6):

4) B>C, D>C, D>E, 5) 60°<B<100°, E<60°,

6) L×0.1<I<L.

9. The ball-point pen according to claim 8, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

10. The ball-point pen according to claim 7, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

11. The ball-point pen according to claim 6, wherein tapered portions C, D and E are formed in the rear of press formed tapered portion B; the width I of the interior sealing face and the press formed width L on the outer side satisfy all the following requirements 4) to 6):

4) B>C, D>C, D>E, 5) 60°<B<100°, E<60°,

6) L×0.1<I<L.

12. The ball-point pen according to claim 1, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

13. The ball-point pen according to claim 6, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

14. The ball-point pen according to claim 5, wherein the point assembly incorporates an elastic element such as a spring therein which constantly urges the ball forward in the axial direction with a weak force equal to or lower than 80 g; the spring or elastic element has an end turn portion or a substantially straight portion which is equivalent to the end turn portion, at the rear end thereof for stable placement; three or more channel grooves constituting ink passage during writing are formed in the rear, with respect to the axial direction, of the ball, the channel grooves being terminated partway not penetrating rearward to the ink reservoir tube.

15. The ball-point pen according to claim 14, wherein tapered portions C, D and E are formed in the rear of press formed tapered portion B; the width I of the interior sealing face and the press formed width L on the outer side satisfy all the following requirements 4) to 6):

4) B>C, D>C, D>E, 5) 60°<B<100°, E<60°,

6) L×0.1<I<L.

16. The ball-point pen according to claim 15, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

17. The ball-point pen according to claim 14, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

18. The ball-point pen according to claim 5, wherein tapered portions C, D and E are formed in the rear of press formed tapered portion B; the width I of the interior sealing face and the press formed width L on the outer side satisfy all the following requirements 4) to 6):

4) B>C, D>C, D>E, 5) 60°<B<100°, E<60°,

6) L×0.1<I<L.

19. The ball-point pen according to claim 18, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

20. The ball-point pen according to claim 5, wherein the ink reservoir tube directly holds an aqueous ink having a viscosity ranging from 10 cp to 4000 cp at 23° C. and a greasy follower in contact with the ink at the rear end thereof, the reduction amount from the writing element due to evaporation at a temperature of 23° C. under a humidity of 60% falls within the range of 0.06 mg/day to 0.8 mg/day (on the average over 30 days).

* * * * *

UNITED STATES PATENT AND TRADEMARK OFFICE

CERTIFICATE OF CORRECTION

PATENT NO. : 6,082,920

DATED : July 4, 2000

INVENTOR(S) : Kzuhiko FURUKAWA

It is certified that error appears in the above-indentified patent and that said Letters Patent is hereby corrected as shown below:

On the title page:

[86] "PCT No.:", please correct the dates under § 371 Date and § 102(e) Date from "Jul. 8, 1999" to read:

-- Jul. 7, 1999 --

Signed and Sealed this

Seventeenth Day of April, 2001

*Attest:*

Nicholas P. Godici

NICHOLAS P. GODICI

*Attesting Officer*

*Acting Director of the United States Patent and Trademark Office*